US012048364B2

(12) United States Patent
Huang

(10) Patent No.: US 12,048,364 B2
(45) Date of Patent: Jul. 30, 2024

(54) FOLDABLE BAG

(71) Applicants: Shenzhen Lemore Marketing Consultancy Co.,Ltd, Shenzhen (CN); Jiecong Li, Shenzhen (CN)

(72) Inventor: Chenglan Huang, Shenzhen (CN)

(73) Assignees: SHENZHEN LEMORE MARKETING CONSULTANCY CO., LTD, Shenzhen (CN); Jiecong Li, Shenzhen (CN)

( * ) Notice: Subject to any disclaimer, the term of this patent is extended or adjusted under 35 U.S.C. 154(b) by 71 days.

(21) Appl. No.: 17/928,964

(22) PCT Filed: Apr. 20, 2021

(86) PCT No.: PCT/CN2021/088427
§ 371 (c)(1),
(2) Date: Dec. 1, 2022

(87) PCT Pub. No.: WO2021/244167
PCT Pub. Date: Dec. 9, 2021

(65) Prior Publication Data

US 2023/0225472 A1 Jul. 20, 2023

(30) Foreign Application Priority Data

Jun. 3, 2020 (CN) ..... 202020997739.5

(51) Int. Cl.
*A45C 7/00* (2006.01)
*A45C 11/00* (2006.01)

(52) U.S. Cl.
CPC ..... *A45C 7/0054* (2013.01); *A45C 2011/002* (2013.01); *A45C 2011/003* (2013.01); *A45C 2200/15* (2013.01)

(58) Field of Classification Search
CPC ..... A45C 7/0054; A45C 2011/002; A45C 2011/003; A45C 2200/15; A45C 7/0077
USPC ..... 206/320
See application file for complete search history.

(56) References Cited

U.S. PATENT DOCUMENTS

| | | | | |
|---|---|---|---|---|
| 8,424,829 | B2 * | 4/2013 | Lu | F16M 11/38 248/152 |
| 9,049,911 | B1 * | 6/2015 | Wood | A45C 11/00 |
| 9,675,147 | B1 * | 6/2017 | Diebel | A45C 11/00 |
| 9,918,534 | B2 * | 3/2018 | Säilä | A45F 5/00 |
| 2006/0285283 | A1 * | 12/2006 | Simonian | F16M 11/38 361/679.55 |

(Continued)

OTHER PUBLICATIONS

Gylint Microsoft Surface Cover: (https://www.amazon.com/Surface-Gylint-Leather-Pencel-Microsoft/dp/B07GWS7DWM?th=1) (Year: 2018).*

*Primary Examiner* — Don M Anderson
*Assistant Examiner* — Justin Caudill
(74) *Attorney, Agent, or Firm* — IPRO, PLLC

(57) ABSTRACT

The present utility model discloses a foldable bag which comprises a first sheet, a second sheet and a third sheet, an accommodating cavity with an opening is enclosed by the first sheet and the second sheet, the third sheet extends from the second sheet and is rotatable to at least partially cover the opening, the first sheet has two corresponding first sides and second sides, the first sheet is provided with a first folding line, a second folding line and a third folding line. The foldable bag can not only contain mobile devices, but also provide support.

10 Claims, 4 Drawing Sheets

(56) References Cited

U.S. PATENT DOCUMENTS

| | | | | |
|---|---|---|---|---|
| 2013/0242490 | A1* | 9/2013 | Ku | G06F 1/1626<br>361/679.56 |
| 2013/0258586 | A1* | 10/2013 | Shao | G06F 1/1613<br>248/688 |
| 2015/0151871 | A1* | 6/2015 | Huang | H05K 5/0086<br>206/45.23 |
| 2015/0296643 | A1* | 10/2015 | Lee | A45C 11/00<br>206/45.2 |
| 2017/0196329 | A1* | 7/2017 | Diebel | B65B 5/04 |
| 2020/0121046 | A1* | 4/2020 | Buechin | A45C 11/00 |
| 2020/0285279 | A1* | 9/2020 | Zimmerman | A45C 11/00 |

* cited by examiner

FOLDABLE BAG

TECHNICAL FIELD

The present utility model belongs to the field of containing bags, and in particular, relates to a foldable bag.

BACKGROUND

Bags currently available usually have a fixed structure and cannot be transformed structurally, and they have no function of supporting mobile devices and cannot adjust the angle of support. Thus, the user of the bag cannot put a mobile device supported (such as a notebook computer and a tablet computer) on the bag in a form convenient for the user to operate.

Therefore, how to transform the bag into a supporting structure of which the supporting angle is adjustable is the technical problem to be solved by those skilled in the art.

SUMMARY

A technical problem mainly solved by the present utility model is to provide a foldable bag, which solves the problem that the bag in the prior art cannot be structurally transformed into a supporting structure.

To solve the above technical problem, a technical solution adopted by the present utility model is to provide a foldable bag, the foldable bag comprises a first sheet, a second sheet and a third sheet, an accommodating cavity with an opening is enclosed by the first sheet and the second sheet, the accommodating cavity is configured to accommodate a mobile device, the third sheet extends from the second sheet and is rotatable to at least partially cover the opening, the first sheet has two corresponding first sides and second sides, both the first sheet and the second sheet have a plurality of folding lines, and the plurality of folding lines include:

a first folding line, being arranged on the first sheet, the beginning and the end of which are respectively adjacent to the corresponding second sides, wherein the first folding line is parallel to the first side;

a second folding line, being arranged on the first sheet and extending obliquely from the beginning of the first folding line to the adjacent first side;

a third folding line, being arranged on the first sheet and extending obliquely from the end of the first folding line to the adjacent first side;

a fourth folding line and a fifth folding line, both being arranged on the second sheet, respectively corresponding to the second folding line and the third folding line, and being folded through the plurality of folding lines to form a three-dimensional supporting structure.

In another embodiment of the foldable bag according to the present utility model, the third sheet is provided with a sixth folding line, which divides the third sheet into a first supporting part and a second supporting part, and the first supporting part and the second supporting part are bendable along the sixth folding line.

In another embodiment of the foldable bag according to the present utility model, the third sheet is in the form of a trapezoid whose side length gradually decreases from the joint of the third sheet and the second sheet toward the extension direction of the free end.

In another embodiment of the foldable bag according to the present utility model, the included angle formed by the second folding line and the first folding line is the same as the included angle formed by the third folding line and the first folding line.

In another embodiment of the foldable bag according to the present utility model, the included angle formed by the second folding line and the first folding line and the included angle formed by the third folding line and the first folding line range from 30° to 60°.

In another embodiment of the foldable bag according to the present utility model, a first area enclosed by the first folding line, the second folding line and the third folding line is provided with a first magnet, the first supporting part is provided with a second magnet, and the first magnet and the second magnet are mutually attracted.

In another embodiment of the foldable bag according to the present utility model, the second sheet is provided thereon with a soft leather which is expandable outward from the inside of the accommodating cavity.

In another embodiment of the foldable bag according to the present utility model, the first side away from the opening is provided with a barrier for blocking the mobile device from sliding off the foldable bag.

In another embodiment of the foldable bag according to the present utility model, the second sheet and the third sheet are an integrally formed structure.

In another embodiment of the foldable bag according to the present utility model, the materials of the first sheet, the second sheet and the third sheet are flexible materials.

Beneficial effects of the present utility model are as follows: the present utility model discloses a foldable bag, which can be folded and transformed along folding lines arranged on the body of the bag and thus transformed into a supporting structure for supporting mobile devices.

DETAILED DESCRIPTION

To facilitate the understanding of the present utility model, the present utility model will be explained in more detail hereinafter with reference to attached drawings and specific embodiments. Preferred embodiments of the present utility model are given in the attached drawings. However, the present utility model can be implemented in many different forms and is not limited to the embodiments described in this specification. On the contrary, these embodiments are provided to make the understanding of the disclosure of the present utility model more thorough and comprehensive.

It shall be noted that, unless otherwise defined, all technical and scientific terms used in this specification have the same meanings as those commonly understood by those skilled in the art of the present utility model. Terms used in the specification of the present utility model are only for the purpose of describing specific embodiments, and are not intended to limit the present utility model.

Figure 1:
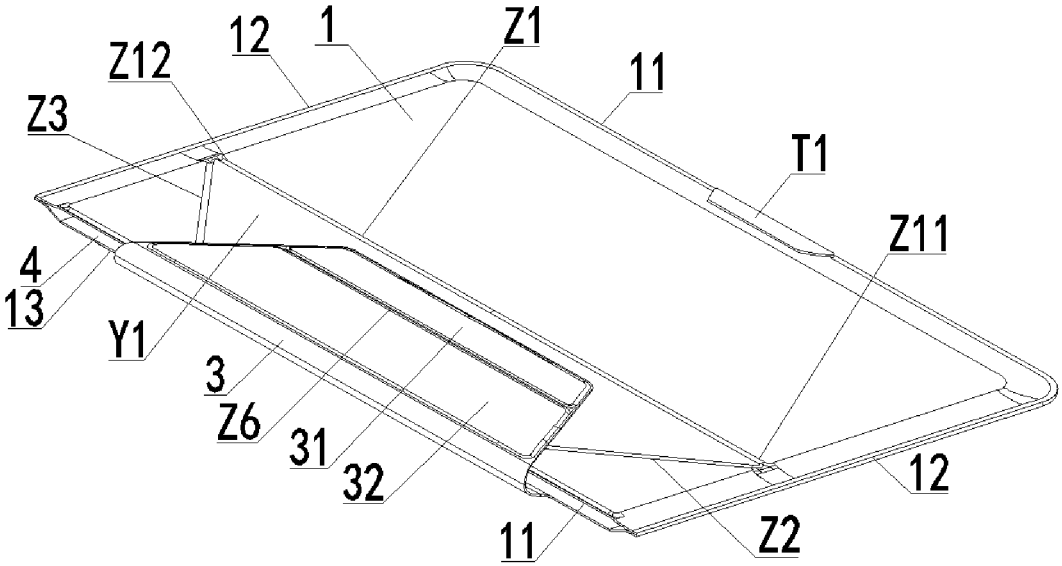
FIG. 1 is a schematic view illustrating an unfolded and untransformed state in an embodiment of a foldable bag according to the present utility model.
Figure 2:
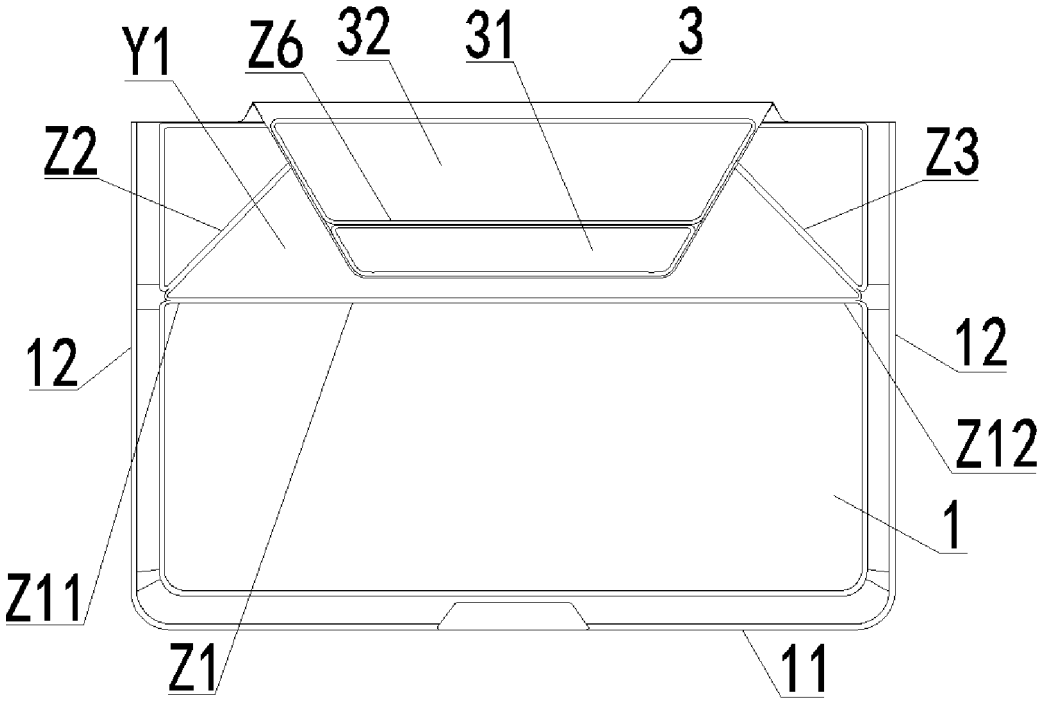
FIG. 2 is a front schematic view in another embodiment of the foldable bag according to the present utility model.
Figure 3:
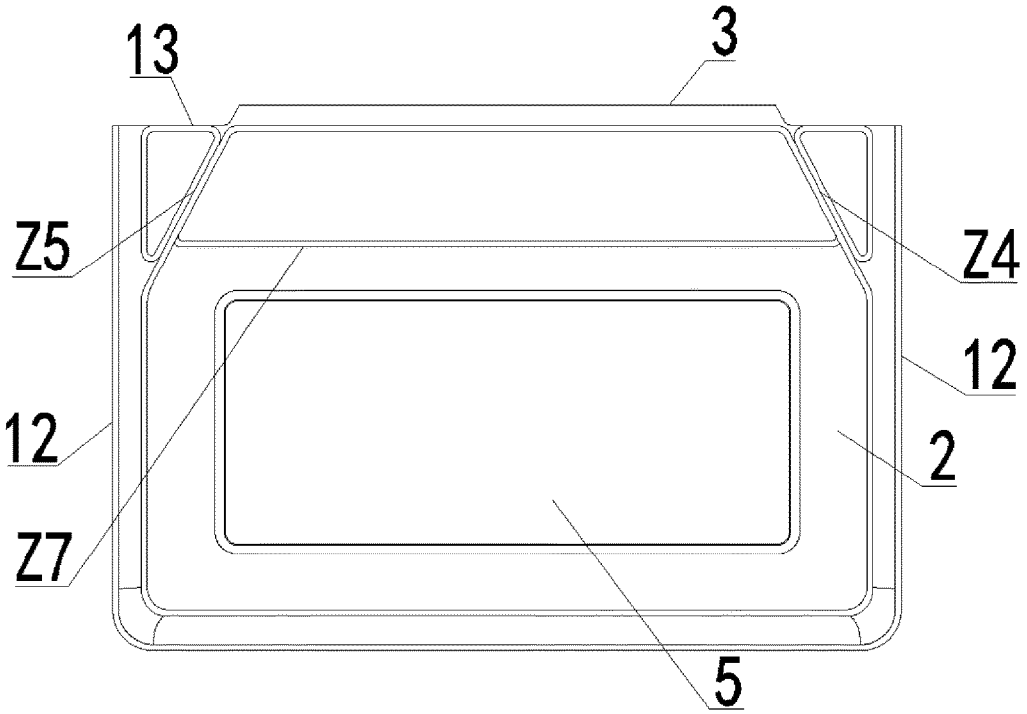
FIG. 3 is a back schematic view in another embodiment of the foldable bag according to the present utility model.

Referring to FIG. 1, FIG. 2 and FIG. 3, the foldable bag comprises a first sheet 1, a second sheet 2 and a third sheet 3, an accommodating cavity 4 with an opening is enclosed by the first sheet 1 and the second sheet 2, the accommodating cavity 4 is configured to accommodate a mobile device, the third sheet 3 extends from the second sheet 2 and is rotatable to at least partially cover the opening, the first sheet 1 has two corresponding first sides 11 and second sides 12, both the first sheet 1 and the second sheet 2 have a plurality of folding lines, and the plurality of folding lines include:

a first folding line Z1, being arranged on the first sheet 1, the beginning Z11 and the end Z12 of which are respectively adjacent to the corresponding second sides 12, wherein the first folding line Z1 is parallel to the first side 11;

a second folding line Z2, being arranged on the first sheet 1 and extending obliquely from the beginning Z11 of the first folding line Z1 to the adjacent first side 11;

a third folding line Z3, being arranged on the first sheet 1 and extending obliquely from the end Z12 of the first folding line Z1 to the adjacent first side 11;

a fourth folding line Z4 and a fifth folding line Z5, both being arranged on the second sheet 2, respectively corresponding to the second folding line Z2 and the third folding line Z3, and being folded through the plurality of folding lines to form a three-dimensional supporting structure.

The mobile device may be a notebook computer or a tablet computer or the like, the shapes of the first sheet 1 and the second sheet 2 are preferably rectangular, but they may also be other shapes.

Preferably, referring to FIG. 1, FIG. 2 and FIG. 3, the side of the second sheet 2 at the side of the opening is a third side 13.

More preferably, the fourth folding line Z4 extends obliquely to the third side 13 from the second side 12 adjacent thereto, the fifth folding line Z5 extends obliquely to the third side 13 from the second side 12 adjacent thereto, the second sheet 2 is provided thereon with a seventh folding line Z7 parallel to the first folding line Z1, the beginning of the seventh folding line Z7 is connected to the fifth folding line Z5, and the end of the seventh folding line Z7 is connected to the fourth folding line Z4.

Preferably, the included angle formed by the second folding line Z2 and the first folding line Z1 is the same as the included angle formed by the third folding line Z3 and the first folding line Z1, and the included angle formed by the seventh folding line Z7 and the fourth folding line Z4 is the same as the included angle formed by the seventh folding line Z7 and the fifth folding line Z5. This form ensures that the foldable bag can have symmetry when folded along the above folding lines, so that the mobile device can be stably placed on the foldable bag that has been transformed and folded without lateral sliding or overturning.

Preferably, the included angle formed by the second folding line Z2 and the first folding line Z1 and the included angle formed by the third folding line Z3 and the first folding line Z1 range from 30° to 60°, and within this range of angles, the foldable bag can be correspondingly transformed and folded into supporting structures with different angles to meet the requirements of different supporting heights.

Preferably, referring to FIG. 1 and FIG. 2, the third sheet 3 is provided with a sixth folding line Z6, which divides the third sheet 3 into a first supporting part 31 and a second supporting part 32, and the first supporting part 31 and the second supporting part 32 are bendable along the sixth folding line Z6.

Preferably, referring to FIG. 1 and FIG. 2, the third sheet 3 is in the form of a trapezoid whose side length gradually decreases from the joint of the third sheet 3 and the second sheet 2 toward the extension direction of the free end, and more preferably, the shape of the third sheet 3 can not only be a trapezoid, but also be a semicircle or an ellipse; that is, any shape of which the width gradually decreases from the joint of the third sheet 3 and the second sheet 2 toward the extension direction of the free end is possible.

Figure 6:
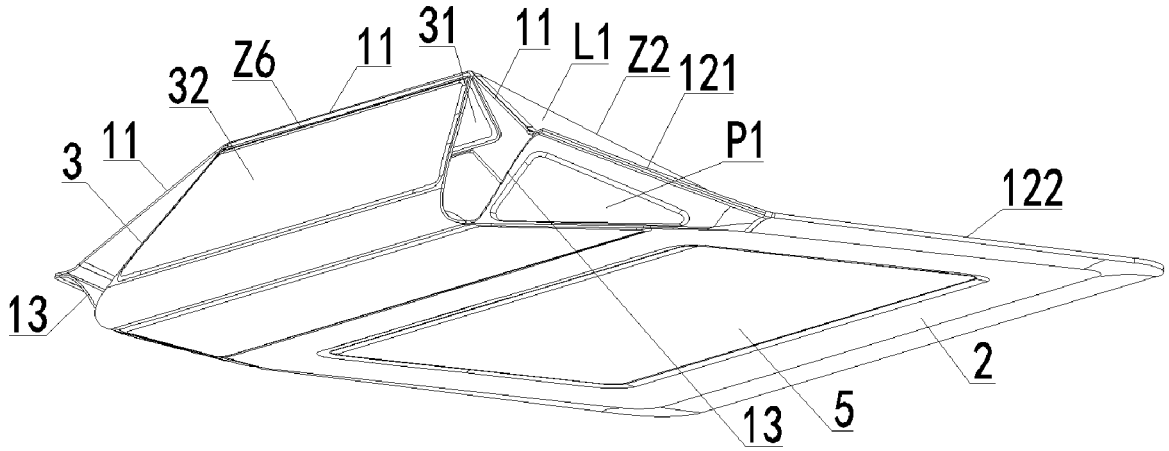
FIG. 6 is a schematic view of a second supporting form in another embodiment of the foldable bag according to the present utility model.

Preferably, referring to FIG. 1 and FIG. 2, a first area Y1 enclosed by the first folding line Z1, the second folding line Z2 and the third folding line Z3 is provided with a first magnet, the first supporting part 31 is provided with a second magnet, and the first magnet and the second magnet are mutually attracted. On the one hand, the first magnet and the second magnet are arranged so that when the foldable bag is unopened as shown in FIG. 1, the third sheet 3 can be tightly attached to the first sheet 1, and the opening can be well covered to prevent the mobile device in the foldable bag from falling off; and on the other hand, the first magnet and the second magnet are arranged so that the first supporting part 31 can be tightly attached and attracted to the inner side of the first area Y1 of the first sheet 1 during the subsequent folding and transformation (another supporting form of the foldable bag as shown in FIG. 6), and thus the first supporting part 31 of the third sheet 3 can stably support the first sheet 1, thereby achieving the purpose of stably supporting the mobile device placed on the first sheet 1.

Figure 4:
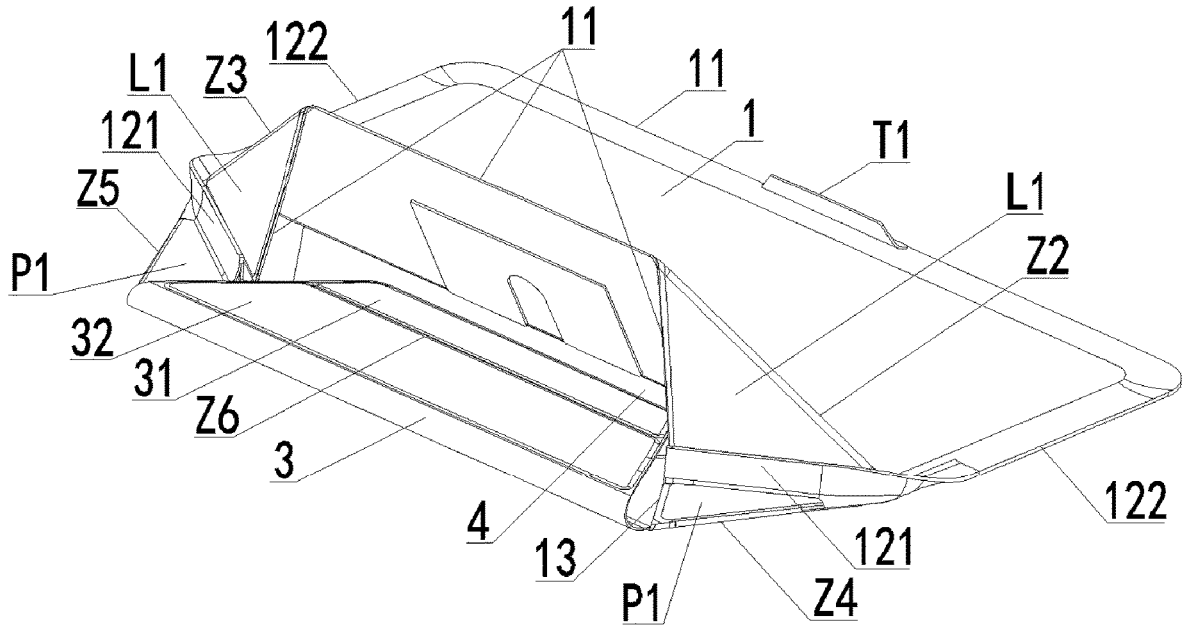
FIG. 4 is a schematic view of a first supporting form in another embodiment of the foldable bag according to the present utility model.
Figure 7:
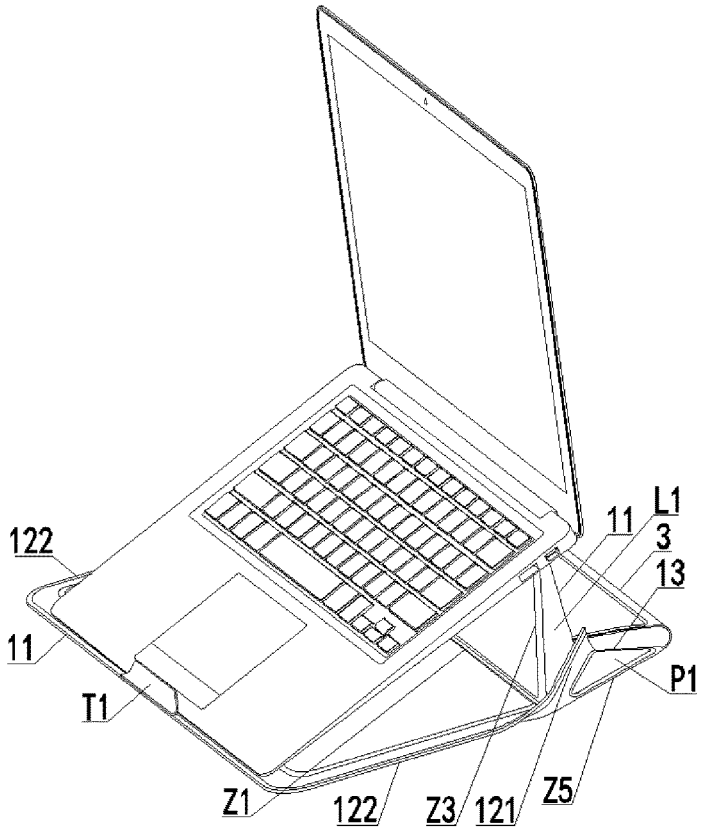
FIG. 7 is a schematic view illustrating the use state in the first supporting form in another embodiment of the foldable bag according to the present utility model.
Figure 8:
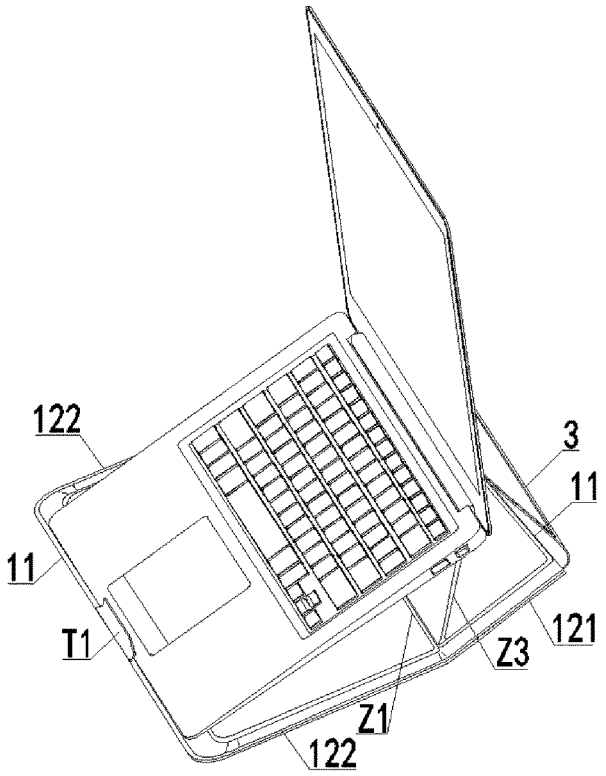
FIG. 8 is a schematic view illustrating the use state in the second supporting form in another embodiment of the foldable bag according to the present utility model.

Preferably, referring to FIG. 1, FIG. 4 and FIG. 7, the first side 11 away from the opening is provided with a barrier T1 for blocking the mobile device from sliding off the foldable bag, and the barrier T1 has two forms. When the foldable bag is not transformed and folded, the barrier T1 is attached to the first sheet 1; and when the foldable bag is transformed and folded, the barrier T1 can be lifted from the first sheet 1, and a notch formed by the lifting operation faces the opening so that when the mobile device is placed on the foldable bag, the lower end of the mobile device can be stuck in the notch or abut against the notch to prevent the mobile device from slipping off Referring to FIG. 1 to FIG. 4 and FIG. 7, the foldable bag is folded along the first folding line Z1, the second folding line Z2, the third folding line Z3, the fourth folding line Z4 and the fifth folding line Z5, and is transformed into a first supporting form as shown in FIG. 4. In the first supporting form, the first area Y1 of the first sheet 1 is tilted, and the second and fourth folding lines Z2 and Z4 as well as the third and fifth folding lines Z3 and Z5 divide the second side 12 into two parts which include a first side part 121 and a second side part 122, wherein the first side part 121 is close to the opening, and the first side part 121 is bent toward the inside of the foldable bag; a third supporting part P1 is enclosed by the fourth folding line Z4, the fifth folding line Z5, the first side part 121 and the third side 13, and the third supporting part P1 is located on the horizontal plane; a fourth supporting part L1 is enclosed by the first side part 121, the second folding line Z2, the third folding line Z3 and the first side 11 adjacent to the second folding line Z2 and the third folding line Z3, the third supporting part P1 and the fourth supporting part L 1 constitute the supporting framework of the first supporting form of the foldable bag, and the third supporting part P1 serves as the supporting base of the fourth supporting part L1, thereby enhancing the supporting strength of the foldable bag.

Preferably, the included angle formed by the plane where the fourth supporting part L1 is located and the plane where the third supporting part P1 is located ranges from 80° to 100°, and in this embodiment, the included angle formed by the plane where the fourth supporting part L1 is located and the plane where the third supporting part P1 is located is 95°. The included angle formed is close to a vertical angle of 90°, which makes the supporting more stable.

Figure 5:
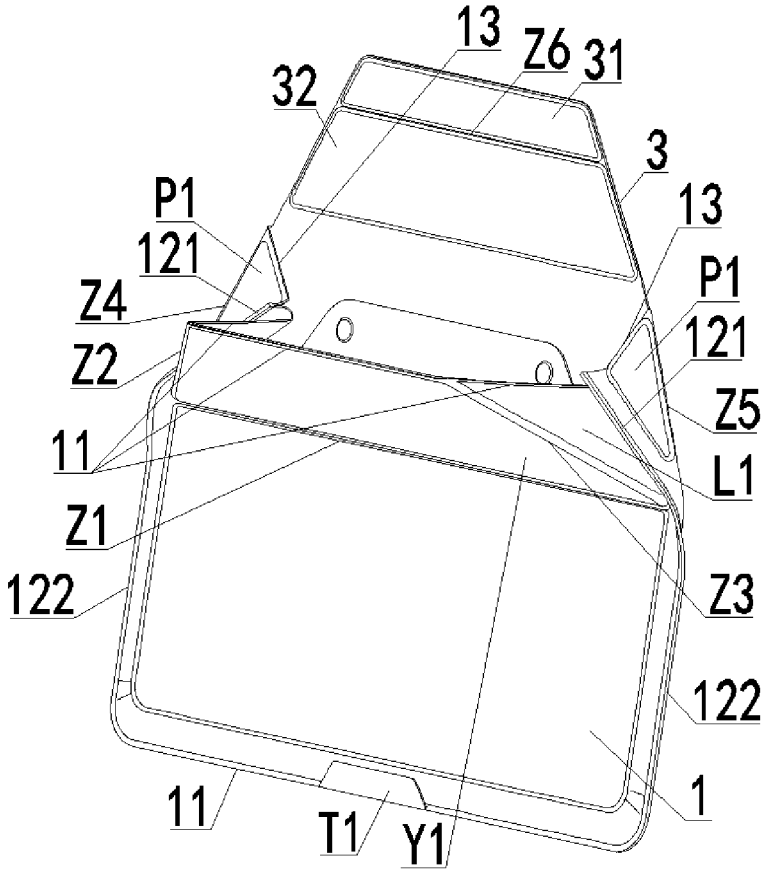
FIG. 5 is a schematic view of the first supporting form in another embodiment of the foldable bag according to the present utility model.

Preferably, the first supporting form may be further divided into two branch forms, which include a first branch form and a second branch form. In the first branch form as shown in FIG. 4, the first supporting part 31 of the third sheet 3 extends into the accommodating cavity 4 by being bent, and this form reduces the area occupied by the foldable bag and improves the space utilization rate, so that the foldable bag is suitable for use on a horizontal plane or desktop with a small area; while in the second branch form as shown in FIG. 5, the third sheet 3 is opened and laid flat on the horizontal plane, and this form can facilitate the user to quickly open and close the opening so that the mobile device can be quickly placed into or taken out of the foldable bag, thereby improving the efficiency of storage, transformation and folding of the foldable bag, and saving time.

Referring to FIG. 1 to FIG. 8, the foldable bag is folded along the first folding line Z1, the second folding line Z2, the third folding line Z3, the fourth folding line Z4, the fifth folding line Z5, and the sixth folding line Z6, and is transformed into a second supporting form as shown in FIG. 6. The second supporting form is similar to the first supporting form, except that the first supporting part 31 is closely attached to and supports the inner side of the first area Y1 of the first sheet 1; the included angle formed by the plane where the third supporting part P1 is located and the plane where the fourth supporting part L1 is located is an acute angle, and the included angle is obviously smaller than the included angle formed by the plane where the third supporting part P1 is located and the plane where the fourth supporting part L1 is located in the first supporting form; the first side part 121 in the second supporting form is not bent towards the inner side of the foldable bag as deep as the first side part 121 in the first supporting form; that is, when the second supporting form is viewed in the direction of the view shown in FIG. 2, the first side part 121 does not extend beyond the fourth folding line Z4 or the fifth folding line Z5; however, when the first supporting form is viewed in the direction of the view shown in FIG. 2, the first side part 121 obviously extends beyond the fourth folding line Z4 and the fifth folding line Z5.

When the first supporting form is compared to the second supporting form, the included angle formed by the plane where the fourth supporting part L1 is located and the plane where the third supporting part P1 is located is closer to 90° in the first supporting form, so the first area Y1 is tilted higher and the supporting angle is higher, and thus the first supporting form is a high-angle supporting form, and the second supporting form is a low-angle supporting form.

Preferably, referring to FIG. 3 and FIG. 6, the second sheet 2 is provided thereon with a soft leather 5 which is expandable outward from the inside of the accommodating cavity 4. With arrangement of the soft leather 5, some small articles, such as a mouse and a charger, can be placed in the foldable bag at a position corresponding to the soft leather 5. Because the soft leather 5 can be expanded and deformed, the accommodating volume of the foldable bag can be increased, and the foldable bag will not be damaged when many articles are placed in the foldable bag.

Preferably, the second sheet 2 and the third sheet 3 are an integrally formed structure, which can enhance the connection strength between the second sheet 2 and the third sheet 3, and prevent the connection position of the third sheet 3 and the second sheet 2 from being worn or broken by repeatedly bending the connection position of the third sheet 3 and the second sheet 2, thereby prolonging the service life of the third sheet 3.

Preferably, the materials of the first sheet 1, the second sheet 2 and the third sheet 3 are flexible materials, such as plastic, elastic metal sheets and leather products or the like.

Preferably, the inner surface of the accommodating cavity 4 of the foldable bag is provided with an inner bag, which can accommodate articles with a smaller volume.

Based on the above embodiments, the present utility model discloses a foldable bag, which comprises a first sheet, a second sheet and a third sheet, an accommodating cavity with an opening is enclosed by the first sheet and the second sheet, the accommodating cavity is configured to accommodate a mobile device, the third sheet extends from the second sheet and is rotatable to at least partially cover the opening, the first sheet has two corresponding first sides and second sides, both the first sheet and the second sheet have a plurality of folding lines, the plurality of folding lines include: a first folding line, being arranged on the first sheet, the beginning and the end of which are respectively adjacent to the corresponding second sides, wherein the first folding line is parallel to the first side; a second folding line, being arranged on the first sheet and extending obliquely from the beginning of the first folding line to the adjacent first side; a third folding line, being arranged on the first sheet and extending obliquely from the end of the first folding line to the adjacent first side; a fourth folding line and a fifth folding line, both being arranged on the second sheet, respectively corresponding to the second folding line and the third folding line, and being folded through the plurality of folding lines to form a three-dimensional supporting structure. The foldable bag can not only carry mobile devices, but also be folded and transformed into a supporting structure.

What described above are only embodiments of the present utility model, and thus are not intended to limit the patent scope of the present utility model; any equivalent structural changes made by using the contents of the specification and the attached drawings of the present utility model, or direct or indirect application in other related technical fields, are included in the scope claimed in the present utility model.

What is claimed is:

1. A foldable bag, being characterized in that, the foldable bag comprising a first sheet, a second sheet and a third sheet, an accommodating cavity with an opening being enclosed by the first sheet and the second sheet, the accommodating cavity being configured to accommodate a mobile device, the third sheet extending from the second sheet and being rotatable to at least partially cover the opening, the first sheet having two corresponding first sides and second sides, both the first sheet and the second sheet having a plurality of folding lines, the plurality of folding lines including:

a first folding line, being arranged on the first sheet, the beginning and the end of which are respectively adjacent to the corresponding second sides, wherein the first folding line is parallel to the first side;

a second folding line, being arranged on the first sheet and extending obliquely from the beginning of the first folding line to the adjacent first side;

a third folding line, being arranged on the first sheet and extending obliquely from the end of the first folding line to the adjacent first side;

a fourth folding line and a fifth folding line, both being arranged on the second sheet, respectively corresponding to the second folding line and the third folding line, and being folded through the plurality of folding lines to form a three-dimensional supporting structure.

2. he foldable bag according to claim 1, being characterized in that, the third sheet is provided with a sixth folding line, which divides the third sheet into a first supporting part and a second supporting part, and the first supporting part and the second supporting part are bendable along the sixth folding line.

3. he foldable bag according to claim 2, being characterized in that, the third sheet is in the form of a trapezoid whose side length gradually decreases from the joint of the third sheet and the second sheet toward the extension direction of the free end.

4. he foldable bag according to claim 1, being characterized in that, the included angle formed by the second folding line and the first folding line is the same as the included angle formed by the third folding line and the first folding line.

5. he foldable bag according to claim 4, being characterized in that, the included angle formed by the second folding line and the first folding line and the included angle formed by the third folding line and the first folding line range from 30° to 60°.

6. he foldable bag according to claim 2, being characterized in that, a first area enclosed by the first folding line, the second folding line and the third folding line is provided with a first magnet, the first supporting part is provided with a second magnet, and the first magnet and the second magnet are mutually attracted.

7. he foldable bag according to claim 1, being characterized in that, the second sheet is provided thereon with a soft leather which is expandable outward from the inside of the accommodating cavity.

8. he foldable bag according to claim 1, being characterized in that, the first side away from the opening is provided with a barrier for blocking the mobile device from sliding off the foldable bag.

9. he foldable bag according to claim 1, being characterized in that, the second sheet and the third sheet are an integrally formed structure.

10. he foldable bag according to claim 1, being characterized in that, the materials of the first sheet, the second sheet and the third sheet are flexible materials.

* * * * *